US008839493B2

(12) United States Patent
Yoshida

(10) Patent No.: US 8,839,493 B2
(45) Date of Patent: Sep. 23, 2014

(54) PAPER HOLDER

(75) Inventor: Tsukasa Yoshida, Saitama (JP)

(73) Assignee: GI Technos Inc., Tokyo (JP)

( * ) Notice: Subject to any disclaimer, the term of this patent is extended or adjusted under 35 U.S.C. 154(b) by 0 days.

(21) Appl. No.: 13/518,273

(22) PCT Filed: Sep. 13, 2010

(86) PCT No.: PCT/JP2010/066114
§ 371 (c)(1),
(2), (4) Date: Jun. 21, 2012

(87) PCT Pub. No.: WO2011/077794
PCT Pub. Date: Jun. 30, 2011

(65) Prior Publication Data

US 2012/0260466 A1 Oct. 18, 2012

(30) Foreign Application Priority Data

Dec. 24, 2009 (JP) ..... 2009-293153

(51) Int. Cl.
*B42F 1/00* (2006.01)
*B42F 1/06* (2006.01)

(52) U.S. Cl.
CPC .. *B42F 1/006* (2013.01); *B42F 1/06* (2013.01)
USPC ..... 24/67.3; 40/658

(58) Field of Classification Search
USPC ..... 24/67.3, 489, 334, 499, 500, 311, 67.5, 24/67.7; 281/42, 43, 44, 45, 46, 47, 48, 281/49, 50, 51, 145; 40/658, 611.12, 792, 40/793, 617, 647, 648; 271/145; 269/143, 269/249, 156, 229; 29/281.1; 248/451; 211/45, 50, 51
See application file for complete search history.

(56) References Cited

U.S. PATENT DOCUMENTS 2,371,713 A * 3/1945 Short ..... 40/360
3,425,389 A * 2/1969 Arcieri et al. ..... 116/236
4,241,477 A * 12/1980 Freedom et al. ..... 24/67 R
(Continued)

FOREIGN PATENT DOCUMENTS

JP 2-71680 U 5/1990
JP 3085201 B2 9/2000
(Continued)

OTHER PUBLICATIONS

Machine translation of JP 2010-149360.*
International Search Report of PCT/JP2010/066114 dated Oct. 12, 2010.

*Primary Examiner* — Thomas Morrison
(74) *Attorney, Agent, or Firm* — Sughrue Mion, PLLC

(57) ABSTRACT

A paper holder is provided which can reliably hold paper, reliably pull out an uppermost piece of paper one by one and, further, leave a straight and clear torn trace on paper such that dust is hardly produced. The paper holder has a case 10 in which a mount portion 12 including a bottom surface portion 11 and an upper covering portion 15 are detachably engaged and integrally formed, and in which a paper insertion opening 19 is formed, and has in the case 10 a holding piece 20 that holds inserted paper and that is provided with a blade 40. The paper holder has an elastic member 30 that biases the holding piece 20 by means of spring force applied in a direction in which the paper is pulled out. The holding piece 20 is made of a plate body having rigidity, and is axially supported rotatably by an axial support portion 17 that is provided inside the front side front surface portion **15*d* of the case 10, and further has a longitudinal surface portion 21 that extends from the axial support portion 17 to a bottom surface portion side. The blade 40 is fixed to a blade fixing member 50. The blade fixing member 50 is provided in a surface of the longitudinal surface portion 21 on a paper insertion direction side such that a tip 43 of the blade projects from an end of the longitudinal surface portion 21** on the bottom surface portion side.

8 Claims, 5 Drawing Sheets

(56) References Cited

U.S. PATENT DOCUMENTS

| | | | | | |
|---|---|---|---|---|---|
| 4,970,813 | A | * | 11/1990 | Ackeret | 40/511 |
| 5,112,083 | A | * | 5/1992 | Morrone | 281/47 |
| 5,193,795 | A | * | 3/1993 | Ackeret | 271/42 |
| 2003/0172570 | A1 | | 9/2003 | Yoshida | |
| 2004/0211101 | A1 | * | 10/2004 | Pitcher et al. | 40/658 |
| 2008/0258452 | A1 | | 10/2008 | Yoshida | |

FOREIGN PATENT DOCUMENTS

| | | | | |
|---|---|---|---|---|
| JP | 2002-120482 | A | | 4/2002 |
| JP | 2005-066859 | A | | 3/2005 |
| JP | 3775222 | B2 | | 5/2006 |
| JP | 2008-188915 | A | | 8/2008 |
| JP | 2010-149360 | | * | 7/2010 |
| WO | 2009/116190 | A1 | | 9/2009 |

* cited by examiner

PAPER HOLDER

CROSS REFERENCE TO RELATED APPLICATIONS

This application is a National Stage of International Application No. PCT/JP2010/066114 filed Sep. 13, 2010, claiming priority based on Japanese Patent Application No. 2009-293153 filed Dec. 24, 2009, the contents of all of which are incorporated herein by reference in their entirety.

TECHNICAL FIELD

The invention relates to a paper holder in which a plurality of pieces of paper can easily be inserted at the same time, from which an upper piece of paper can be reliably pulled out one by one without dropping lower pieces of paper, and which leaves a straight and clear torn trace on the paper which is pulled out.

BACKGROUND ART

Conventionally, there are various paper holders which are used to pinch and fix paper. A well-known paper holder has as its basic structure an insertion opening which is provided on one side of a case and which allows insertion of paper, and a holding member which is provided inside the case and which holds the paper.

Patent Document 1 discloses a document holder which has "a rotating body which is arranged in an insertion groove and which normally rotates or reversely rotates following movement of a document inserted in the insertion groove, and a needle body which is formed on the surface of the rotating body and which moves back and forth to and from the insertion groove following rotation of the rotating body", and in which "the needle body moves into the insertion groove to pierce and hold the document upon reverse rotation of the rotating body". Further, Patent Document 1 also describes a configuration where "the rotating body is biased in a reversion rotation direction by biasing means".

Patent Document 2 discloses a card holder which was invented by the inventors of the present application. This document discloses a configuration where "a card insertion opening is provided in one side portion by engaging an outer covering piece with one end of a basic piece having a thick portion and a card pinching piece having elasticity is attached to the outer covering piece such that one end of the card pinching piece abuts against the basic piece in a space formed by the basic piece and the outer covering piece", and a configuration in which "the card pinching piece is constituted by a plate spring, one end portion of which is an attachment portion of the outer covering piece, and is folded with a slope from an end of the attachment portion, so that the card pinching piece is formed in a mountain-like shape".

The document holder described in Patent Document 1 pierces and holds the document by means of the needle body formed on the surface of the rotating body which rotates together when the document moves ([0012], FIGS. 3 and 4). This document holder can pull out unnecessary paper by pulling the unnecessary paper and tearing a portion which is pierced by the needle ([0025]). This document holder can be used as a production instruction document holder and the like in factory lines.

However, the paper which is pulled out is torn by the needle body which pierced this paper. Therefore, a jaggy torn trace is left. Hence, dust or dirt scattering away from the torn portion of a paper material is produced and flies apart. Therefore, this holder is not appropriate for use in, for example, a clean room. Further, a configuration which allows replacement of the needle body which is worn away by use is not disclosed at all.

The card holder described in Patent Document 2 directly holds paper by means of the card pinching piece constituted by the plate spring. That is, this card holder does not hold paper by means of a member having a sharp tip like a needle. Therefore, paper is not held reliably.

In addition, as holders which pinch paper like clips (such as alligator clips) or clothes pins, there are holders provided with a needle. However, with this configuration, it is necessary to perform an opening/closing operation of picking a picking portion to hold paper, and therefore, it is not possible to easily insert and pull out paper.

Patent Document 1: Japanese Patent No. 3085201
Patent Document 2: JP-A-2002-120482

DISCLOSURE OF THE INVENTION

Problems to be Solved by the Invention

The invention has been accomplished in view of the aforesaid technical background. It is an object of the invention to provide a paper holder which can allow a plurality of pieces of paper to be easily inserted at the same time, reliably hold inserted paper, reliably pull out an uppermost piece of the held paper one by one without dropping lower pieces of paper, and leave a straight and clear torn trace on paper which is pulled out. Further, it is another object of the invention to provide a paper holder which is easy to manufacture and disassemble, and also allows parts such as blades to be replaced easily.

Solutions to the Problems (1) A paper holder comprising: a case including a mount portion that includes a bottom surface portion, and an upper covering portion having an upper surface portion separated across a space from the bottom surface portion and opposing to the bottom surface portion nearly in parallel, and, at a front end of the upper surface portion, a front side front surface portion nearly in a U-shape from a side view, the mount portion and the upper covering portion being detachably engaged and integrated with each other, an insertion opening for paper being formed below the front side front surface portion; a holding piece that is provided in the case for holding inserted paper; an elastic member that biases the holding piece by means of spring force applied in a direction in which the paper is pulled out; and a blade that is provided to the holding piece, wherein the holding piece is formed with a plate body having rigidity and is axially supported rotatably by an axial support portion that is provided inside the front side front surface portion, and the holding piece further includes a longitudinal surface portion that extends from the axial support portion to a bottom surface portion side, the blade is fixed to a blade fixing member that holds a perpendicular standing state of the blade with respect to the holding piece, the blade fixing member is provided in a surface of the longitudinal surface portion on a paper insertion direction side such that a tip of the blade projects from an end of the longitudinal surface portion on the bottom surface portion side, and a friction portion for preventing the inserted paper from dropping is provided in an inner surface of the bottom surface portion.

(2) With another configuration, the holding piece includes a lateral surface portion that is curved in a nearly dogleg shape from a side view and that continues to the longitudinal surface portion, and is further axially supported by the axial support portion in a vicinity of a curved portion where the longitudinal surface portion and the lateral surface portion cross, and the elastic member engages with the lateral surface portion.

(3) With still another configuration, an end of the lateral surface portion is reversed and folded back to form a groove portion, a plate spring that is the elastic member is arranged virtually along an inner surface of the upper surface portion, and part of the plate spring is inserted in and engaged with the groove portion.

(4) With still another configuration, a bent portion is formed by bending the end of the longitudinal surface portion toward the paper insertion direction side, the blade fixing member is fixed to fit with the bent portion, and a slit through which the blade is inserted is formed in a center portion of the bent portion in a width direction.

(5) With still another configuration, engaging means for disengageably engaging the blade fixing member is provided in a predetermined position of the longitudinal surface portion.

(6) With still another configuration, the blade fixing member includes: a base portion that is fixable to the longitudinal surface portion; and a standing portion that stands perpendicularly from the base portion and holds a belly portion of the blade from both sides.

(7) With still another configuration, the blade includes: a back portion and a blade edge that cross each other to form a sharp tip of the blade; and an inclining side portion that is formed to extend at an angle from a vicinity of a blade base to the back portion.

Effects of the Invention (1) In the case, the mount portion and upper covering portion are detachably engaged and integrally formed. Further, as a result of this integration formation, the paper insertion opening is formed in the case. Consequently, this case is easily manufactured and disassembled.

The holding piece is axially supported rotatably by the axial support portion that is provided inside the front side front surface portion, and further has the longitudinal surface portion that extends from the axial support portion to the bottom surface portion side. Therefore, the holding piece is arranged such that a space formed by the bottom surface portion and the upper covering portion is utilized most effectively. Consequently, the product is not made larger. Further, it is possible to provide a larger rotation radius of the holding piece (and blade) in a limited narrow space. Consequently, when paper is inserted and pulled out, it is possible to secure a smooth and stable operation of the holding piece.

The holding piece is made of a plate member having rigidity and, consequently, can be manufactured simply by, for example, processing the plate member.

The blade is fixed to the blade fixing member that holds a perpendicular standing state of the blade with respect to the holding piece. The blade fixing member is provided in the surface of the longitudinal surface portion on the paper insertion direction side such that the blade tip projects from the end of the longitudinal surface portion on the bottom surface portion side. Consequently, the blade is reliably held by the blade fixing member in a predetermined position with a predetermined orientation. Further, the blade is easily assembled and attached to the holding piece using the blade fixing member.

According to the invention, following insertion of paper, the holding piece rotates in the space formed between the bottom surface portion and the upper covering portion. Further, paper is held by having the blade tip abut on inserted paper by means of the spring force of the elastic member which works on the holding piece. Consequently, paper is held reliably. Further, it is possible to reliably pull out the uppermost piece of the held paper one by one.

Further, a straight and clear torn trace is left by the blade on the paper which is pulled out. Therefore, dust is not likely to be produced. Dust is not likely to be produced, so that the invention is suitable for use in a place where dust and dirt are not desirable in, for example, a factory clean room. Further, the invention allows parts to be easily maintained, disassembled, fixed and replaced.

In addition, with the invention disclosed in Patent Document 1, a needle body is formed on the surface of the rotating body (shaft). Therefore, when a larger rotation radius is secured, the diameter of the rotating body becomes greater, and a space matching this diameter is required. By contrast with this, the invention can set the position of the holding piece without requiring such a space. Consequently, a large rotation radius of the holding piece can be secured, so that it is possible to perform a stable operation.

Further, the blade has a blade edge (blade length) portion having a certain length and a back portion, which is different from the needle body. Consequently, the blade has the height matching the blade length portion, so that a belly portion having a predetermined area is surely formed. However, the invention makes a device such that the holding piece including this blade is arranged in a narrow space in the case while securing its smooth and stable operation.

(2) With another configuration, the holding piece has the lateral surface portion that is curved in the nearly dogleg shape from the side view and that continues to the longitudinal surface portion, and further is axially supported in the vicinity of the curved portion where the longitudinal surface portion and lateral surface portion cross. Further, the elastic member engages with the lateral surface portion. With this configuration, the holding piece can be adequately biased by the spring force of the elastic member.

(3) With still another configuration, the end of the lateral surface portion is reversed and folded back, thereby forming the groove portion. Further, the plate spring which is the elastic member is arranged virtually along the inner surface of the upper surface portion. Furthermore, part of the plate spring is inserted in and engaged with the groove portion. With this configuration, a simple and low-cost plate spring is used as the elastic member. Hence, it is possible to easily and reliably engage the elastic member with the holding piece. Consequently, the above configuration can be manufactured in a simple manner.

(4) With still another configuration, the end of the longitudinal surface portion of the holding piece is bent toward the paper insertion direction. By this means, the bent portion is formed. Further, the blade fixing member is fixed to fit with the bent portion. Hence, the bent portion serves as an alignment portion for the blade fixing member in the longitudinal direction. Consequently, it is possible to easily fix the blade fixing member to an adequate position of the holding piece. The slit in which the blade is inserted through is formed in the center portion of the bent portion in the width direction. Hence, the slit serves as the alignment portion for providing the blade in a predetermined position in the lateral direction. By this means, it is possible to easily fix the blade in an adequate position of the holding piece.

(5) With still another configuration, the engaging means for disengageably holding the blade fixing member in a predetermined position of the longitudinal surface portion is provided. With this configuration, it is possible to reliably and easily attach the blade fixing member to a predetermined position of the longitudinal surface portion. Further, it is possible to attach and detach the blade fixing member. When the blade is worn away, only the blade fixing member provided with the blade needs to be detached from the longitudinal surface portion and replaced, which is convenient and economic.

(6) With still another configuration, the blade fixing member has the base portion that is fixed to the holding piece and the standing portion that stands perpendicularly from this base portion and holds the blade belly portion from both sides. Consequently, the configuration of the blade fixing member is simple and its manufacturing cost is low.

(7) With sill another configuration, the blade has the shape having the back portion and the blade edge that cross each other, thereby forming the sharp blade tip, and the inclining side portion that is extended inclining from the vicinity of the blade base to the back portion. Hence, the blade is arranged in a narrow inner space of the case in a reasonable manner. Consequently, movement of the holding piece including the blade is not interfered by the case. Therefore, the blade and holding piece operate reliably.

BEST MODE FOR CARRYING OUT THE INVENTION

Figure 1:
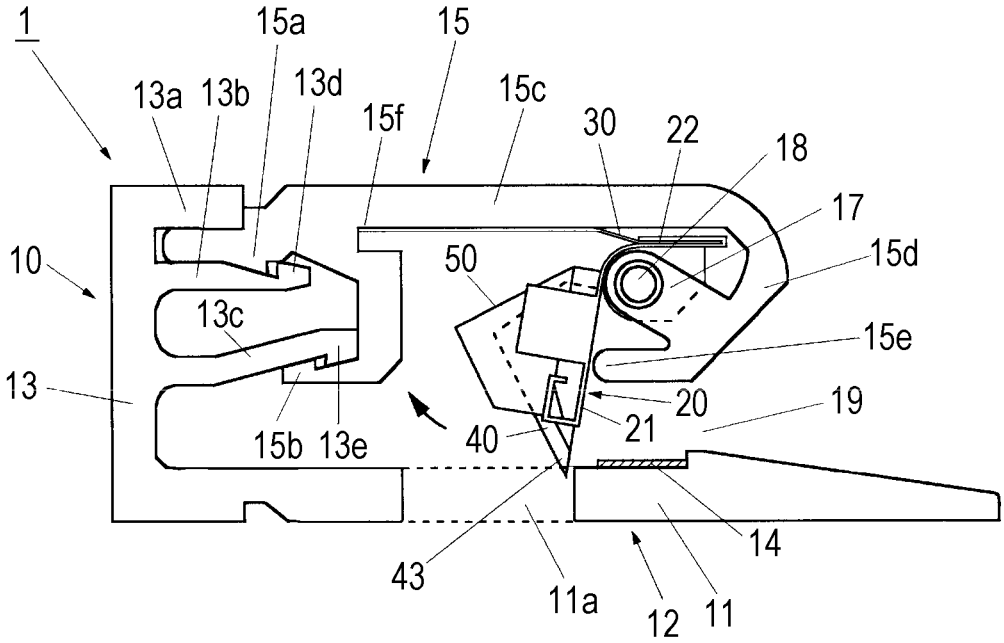
FIG. 1 illustrates a side view of a paper holder 1.

An embodiment of the invention will be described with reference to the drawings. However, the invention is not limited to the following embodiment.

Embodiment (Case)

A paper holder 1 has a case 10 and a holding piece 20 which is mounted inside the case 10.

The case 10 is made of a combination of molded products having two different types of cross-sections of a mount portion 12 which includes a bottom surface portion 11 and an upper covering portion 15 which is positioned on a side opposing the bottom surface portion 11. Both of the molded products are detachably engaged and integrally formed. As a result of this integral formation, a paper insertion opening 19 is formed in the front side. The mount portion 12 and upper covering portion 15 are made of, for example, a hard synthetic resin material. The size of the case 10 is not limited. For example, the case 10 has the height of about 1.2 to 2 cm, the depth of about 3 to 5 cm and the width of about 2.5 to 6 cm.

In the mount portion 12 of the case 10, a rear wall portion 13 which stands at a nearly right angle from the rear end of the mount portion 12. The rear wall portion 13 is engaged with the upper covering portion 15. In the inner surface of the rear wall portion 13, projecting pieces 13*b* and 13*c* are formed. The projecting pieces 13*b* and 13*c* are spaced a little distance apart from an upper end hook-shaped portion 13*a* and project at two upper and lower levels. Engagement portions 13*d* and 13*e* at the tips of the projecting pieces 13*b* and 13*c* are respectively engaged with and integrally formed with engagement portions 15*a* and 15*b* formed at two upper and lower levels at the rear end of the upper covering portion 15.

The upper covering portion 15 has a planar upper surface portion 15*c* which is separated across a space from and opposed to the bottom surface portion 11 in nearly parallel, and a front side front surface portion 15*d* which is arranged at the front side of the upper surface portion 15*c* and which forms a nearly U-shape from the side view. Between the lower end of the front side front surface portion 15*d* and bottom surface portion 11, the paper insertion opening 19 is formed. The lower end of the front side front surface portion 15*d* extends nearly horizontally in a paper insertion direction. The front end 15*e* functions as a stopper for regulating movement of a longitudinal surface portion 21 of the holding piece 20 in a direction in which paper is pulled out. The holding piece 20 will be described below.

Inside the front side front surface portion 15*d*, an axial support portion 17 which axially supports the holding piece 20 which will be described below is formed projecting from the front side front surface portion 15*d* to the U-shaped space (space between the upper surface portion 15*c* and the lower end of the front side front surface portion). That is, the axial support portion 17 is positioned near the inner surface of the upper surface portion 15*c* on the front end side. In this axial support portion 17, a hole in which a shaft 18 can be inserted is formed in a lateral direction (width direction of the case).

Figure 2:
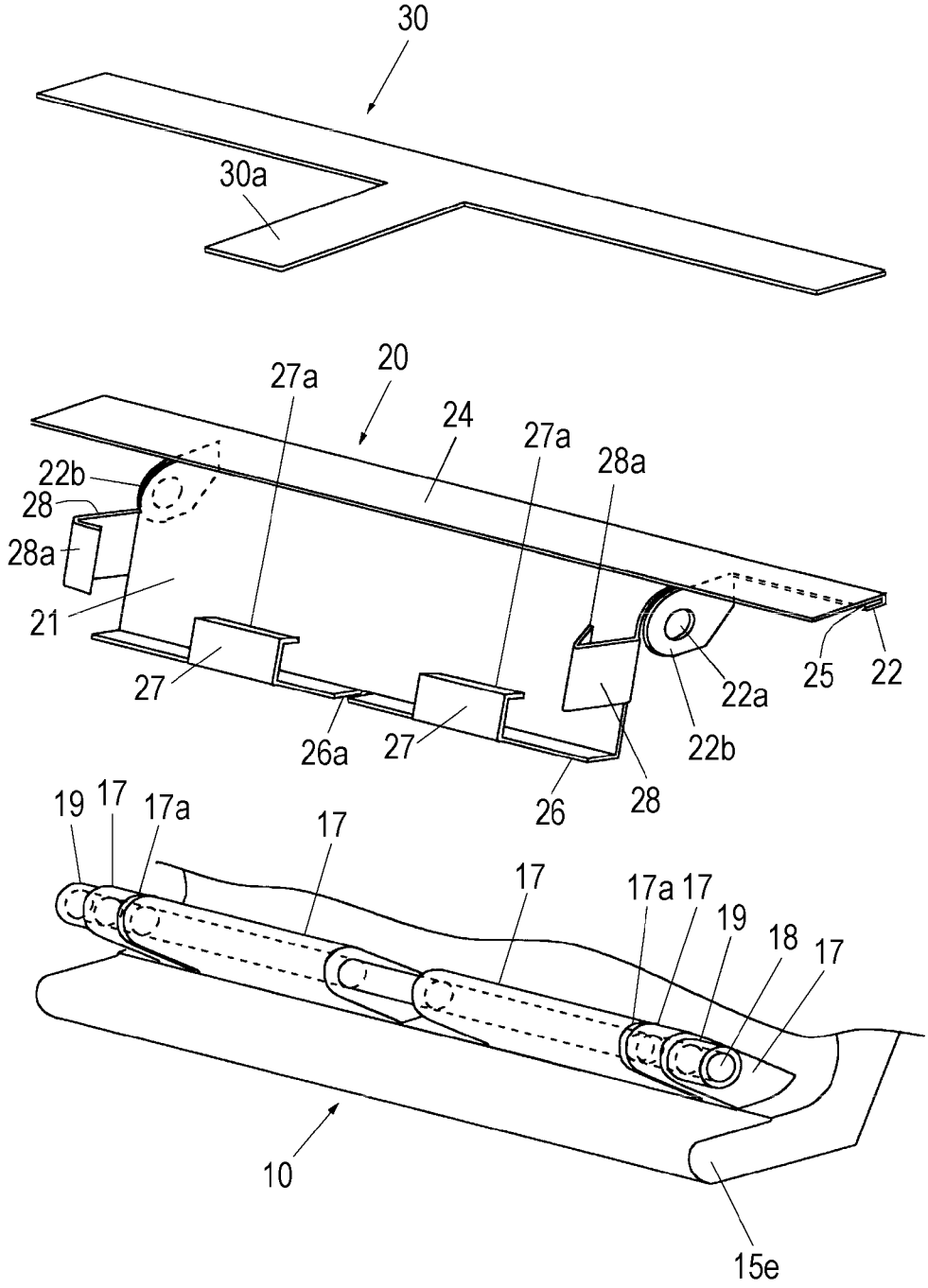
FIG. 2 illustrates a perspective view illustrating an elastic member 30, a holding piece 20 and an axial support portion 17.

Further, as illustrated in FIG. 2, slits 17*a* and 17*a* are formed at both sides of the axial support portion 17 in the width direction. Attachment portions 22*b* of the holding piece 20 which will be described below are inserted in these slits 17*a* and 17*a*.

At the rear end of the inner surface of the upper surface portion 15*c*, an engagement portion 15*f* is formed. The engagement portion 15*f* engages an elastic member 30 which will be described below.

In at least the inner surface of the bottom surface portion 11 which is closer to the insertion opening 19 than a tip of a blade 40 which will be described below, a friction portion 14 is provided. The friction portion 14 prevents inserted paper 70 from dropping. The friction portion 14 prevents paper from dropping by increasing friction force of the inserted paper with respect to the bottom surface portion 11. With the example illustrated in the drawings, the friction portion 14 is formed by being pasted a sheet member such as rubber.

As described above, the case 10 is made of a hard synthetic resin material, and is formed with a mount portion 12 which has the bottom surface portion 11 and the rear wall portion 13 which is integrally molded with the bottom surface portion 11 to stand from the rear end of the bottom surface portion 11, and the upper covering portion 15 which is detachably engaged with the engagement portion formed in the rear wall portion 13 and integrally formed with the mount portion 12. The case 10 can be disassembled by sliding the mount portion 12 and upper covering portion 15 in the opposite directions from each other along the lateral direction.

(Holding Piece)

The holding piece 20 is made, for example, a plate body which is subjected to bending processing and which has certain rigidity. The holding piece 20 is axially supported to be rotatable about the axial support portion 17 provided inside the front side front surface portion 15. Further, the holding piece 20 has the longitudinal surface portion 21 which extends from the axial support portion 17 to the bottom surface portion 11 side.

The holding piece 20 can be formed with, for example, a metal plate such as a SK material or stainless steel having the thickness of about 0.1 to 0.3 mm. The holding piece 29 itself may have some elasticity. However, the holding piece 20 is manufactured such that rigidity of the holding piece 20 becomes greater than the elastic member 30 which will be described below, when the holding piece 20 is used (when the holding piece 20 rotates). The width of holding piece 20 is, for example, about 2 to 4 cm.

The holding piece 20 is curved in a nearly dogleg shape from the side view. The holding piece 20 has a lateral surface portion 22 which continues to the longitudinal surface portion 21. The holding piece 20 is axially supported by the axial support portion 17 in the vicinity of a curved portion where these longitudinal surface portion 21 and lateral surface portion 22 cross in an r shape.

As illustrated in FIG. 2, in the vicinity of both ends of the lateral surface portion 22 of the holding piece 20, the attachment portions 22*b* and 22*b* are formed. These attachment portions 22*b* and 22*b* are bent downward at a right angle, and have axial insertion holes 22*a* in which a shaft 18 is inserted. These attachment portions 22*b* and 22*b* are inserted in the slits 17*a* and 17*a* formed in the axial support portion 17. By inserting the shaft 18 in the hole of the axial support portion 17 and the axial insertion hole 22*a* of the attachment portion 22*b* and then stopping the shaft 18 using a stopper 19 (for example, an elastic cylindrical body such as silicon rubber), the holding piece 20 is axially supported by the axial support portion 17. Consequently, the holding piece 20 can be attached and detached to and from the case 10.

Further, the end of the lateral surface portion 22 (on the front side front surface portion side) is reversed upward and folded back. By this means, a folded portion 24 and groove portion 25 are formed. One end of the elastic member (plate spring 30) which will be described below is inserted in and engaged with this groove portion 25.

The lower end of the longitudinal surface portion 21 (on the bottom surface portion side) is bent toward the paper insertion direction, thereby forming a bent portion 26. A blade fixing member 50 which will be described below is fixed to fit with the bent portion 26.

In the center portion of the bent portion 26 in the width direction, a slit 26*a* in which the blade fixed to the blade fixing member 50 is inserted is formed. The bent portion 26 serves as an alignment portion in the longitudinal direction for the blade fixing member 50 which will be described below. The slit 26*a* serves as an alignment portion in the lateral direction for the blade 40 provided to the blade fixing member 50. The tip 43 of the blade 40 projects from the end of the longitudinal surface portion 21 on the bottom surface portion side passing through the slit portion 26*a*.

Further, engaging means for disengageably holding the blade fixing member 50 in a predetermined position of the longitudinal surface portion 21 of the holding piece 20 is provided.

With the embodiment, as engaging means for disengageably holding the blade fixing member 50 in a predetermined position of the longitudinal surface portion 21 in the longitudinal direction, engagement portions 27 having curved portions 27*a* at their front ends are provided. These engagement portions 27 are provided continuing from the end of the bent portion 26 along the direction going along the longitudinal surface portion 21.

Further, as engaging means for holding disengageably the blade fixing member 50 in a predetermined position of the longitudinal surface portion 21 in the lateral direction, standing engagement portions 28 having curved portions 28*a* at their front ends are provided. The standing engagement portions 28 are provided continuing from each end of the longitudinal surface portion 21.

(Elastic Member)

The elastic member 30 biases the holding piece 20 by means of the spring force applied in the direction in which paper is pulled out.

With the embodiment, as illustrated in FIG. 2, the elastic member 30 is formed with the plate spring 30 having a nearly T-shape from a plan view. The plate spring 30 can be formed with, for example, a metal plate such as a SK material and stainless steel having the thickness of about 0.06 to 0.09 mm. By adequately setting the width of a center belt portion 30*a* of the plate spring 30, spring force can be adjusted.

The plate spring 30 is arranged virtually along the inner surface of the upper surface portion 15*c* of the upper covering portion 15 of the case 10. A part (front portion) of the plate spring 30 is inserted and engaged with the groove portion 22 of the holding piece 20. The rear end portion (center belt portion) of the plate spring 30 is engaged with the engagement portion 15*f* formed at the rear end in the inner surface of the upper surface portion 15*c*. Consequently, the elastic member 30 can be attached and detached to and from the case 10.

(Blade)

For the blade 40, a steel such as carbon tool steel (SK) used for a blade of a cutter knife is preferably used. The thickness of the blade 40 is generally about 0.3 to 1.2 mm.

Figure 3:
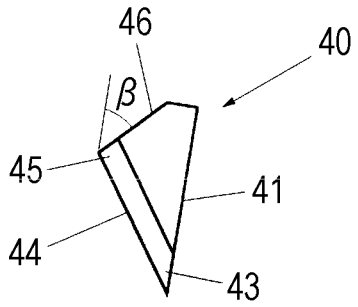
FIG. 3 illustrates a side view of a blade 40.

As illustrated in FIG. 3, the blade 40 has a back portion 41 extending straight, a blade edge (edge) 44, a blade base 45 (the base of the blade edge 44) and an inclining side portion 46. The blade edge 44 crosses the back portion 41, thereby forming a sharp blade tip (point) 43. The blade base 45 is in a position opposing to the back portion 41. The inclining side portion 46 extends inclining from the vicinity of this blade base 45 to the back portion 41. The inclining angle β of this inclining side portion 46 is in the range of nearly 15 to 60 degrees. The angle of the tip 43 of the blade 40 is generally about 30 to 60 degrees. The length of the back portion 41 of the blade 40 is, for example, about 6 to 12 mm.

(Blade Fixing Member)

The blade fixing member 50 is a member attached to the longitudinal surface portion 21 of the holding piece 20. This blade fixing member 50 fixes and holds the blade 40 in a predetermined position. The blade 40 is provided to the blade fixing member 50 such that the tip 43 of the blade 40 projects. Further, the blade 40 is fixed to the blade fixing member 50 such that the blade 40 stands perpendicularly with respect to the plane of the longitudinal surface portion 21.

Figure 4:
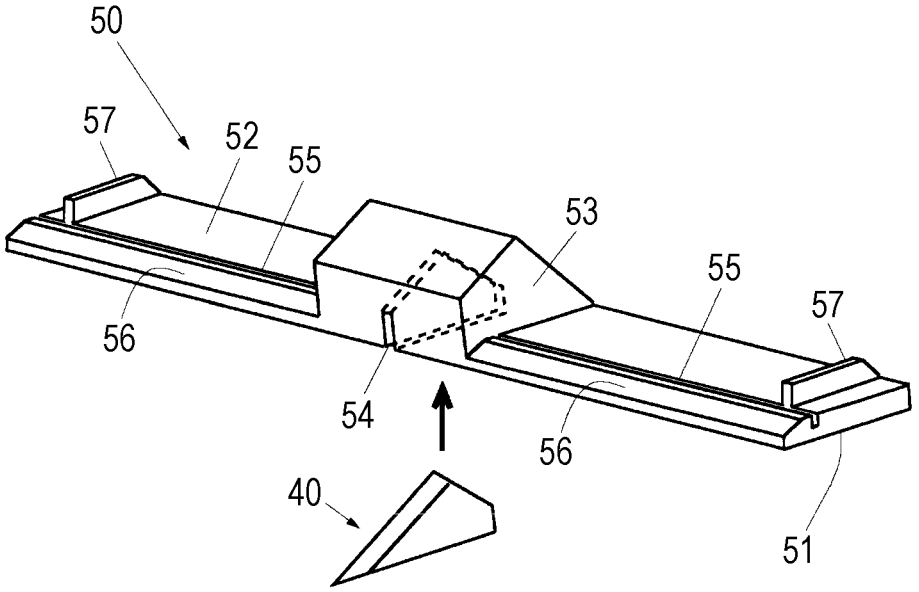
FIG. 4 illustrates a perspective view of a blade fixing member 50.

As illustrated in FIG. 4, the blade fixing member 50 has a base portion 52 and a standing portion 53. The base portion 52 has a planar portion (bottom surface portion) 51 which is fixed to the longitudinal surface portion 21 of the holding piece 20. The standing portion 53 stands perpendicularly from the base portion 52, and holds the belly portion (flat portion) of the blade 40 from both sides. The standing portion 53 has the height matching with the height of the blade 40. In this standing portion 53, a slit 54 matching the outline of the blade 40 is formed. By inserting and fixing the blade 40 in this slit 54, the perpendicular state of the blade 40 with respect to the base portion 52 is held. The blade fixing member 50 can be formed with a molded product of a synthetic resin.

Using the planar portion 51 of the base portion 52 of the blade fixing member 50, the blade fixing member 50 is fixed to the inner surface of the longitudinal surface portion 21 of the holding piece 20 on the insertion direction side in a nearly center portion in the width direction. The fixing member 50 is fixed such that the base member 52 of the blade fixing member 50 is adjusted to the bent portion 26 at the lower end of the longitudinal surface portion 21. The blade 40 is fixed such that a state is held where the blade stands perpendicularly with respect to the surface of the longitudinal surface portion 21. Further, the blade 40 is provided such that the blade 40 passes the slit 26*a* of the longitudinal surface portion 21 and the tip 43 of the blade 40 projects from the end on the bottom surface portion 11 side. The back portion 41 of the blade 40 is attached along the longitudinal surface portion 21.

At this time, the blade 40 has the back portion 41 and blade edge 44 which cross each other, thereby forming the sharp blade tip 43, and the inclining side portion 46 which extends inclining from the vicinity of the blade base 45 to the back portion 41. That is, the blade 40 has a nearly triangular shape as a whole which adopts the back portion 41 as the bottom side. Therefore, the blade 40 is arranged in a narrow inner space of the case in a reasonable manner. Further, movement of the longitudinal surface portion 21 does not block movement of the blade (the side opposing the back portion 41 does not hit the upper surface portion 15*c* of the elastic piece 20). Hence, the holding piece 20 including the blade 40 operates reliably.

A double-sided adhesive tape, adhesive or other adequate fixing means can be used to fix the blade fixing member 50 to the longitudinal surface portion 21.

Figure 5:
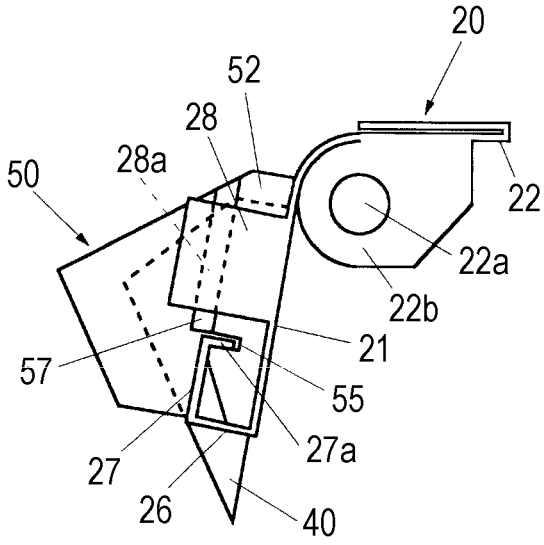
FIG. 5 illustrates a side view illustrating a state where the blade fixing member 50 is attached to a longitudinal surface portion 21.

In the embodiment, recessed groove portions 55 are formed in the surface of the base portion 52. The recessed groove portions 55 are engageable with the engagement portions 27 (curved portions 27*a*) which are provided continuing to the bent portion 26 of the longitudinal surface portion 21. Tapered portions 56 having thin front ends are formed closer to the end than these recessed groove portions 55. Hence, it is easy to attach the blade fixing member 50 to the longitudinal surface portion 21 (see FIG. 5 illustrating a state where the blade fixing member 50 is attached to the longitudinal surface portion 21).

Further, in the vicinity of both ends of the blade fixing member 50 in the lateral direction, projected portions 57 are formed. The projected portions 57 are engageable with the standing engagement portions 28 that are provided at ends of the longitudinal surface portion 21, respectively. On the outer sides of these projected portions 57 in the lateral direction, the curved portions 28*a* of the standing engagement portions 28 abut.

Consequently, the blade fixing member 50 can be reliably and easily attached to a predetermined position of the longitudinal surface portion 21. Further, it is possible to attach and detach the blade fixing member 50 to and from the longitudinal surface portion 21 (holding piece 20). When the blade 40 is worn away, only the blade fixing member 50 provided with the blade 40 needs to be detached from the longitudinal surface portion 21 and replaced, which is convenient and economic.

As illustrated in FIG. 1, in the vicinity of the portion of the bottom surface portion 11 of the case 10 where the tip 43 of the blade 40 is positioned, a through-hole (or recessed portion) 11*a* of a planar shape is formed for convenience sake (for convenience, only the vicinity of this portion is illustrated in a cross-section). The tip 43 of the blade 40 is accommodated in a space of the through-hole 11*a*. As described above, the lower end of the front side front surface portion 15*d* extends nearly horizontally along the paper insertion direction. Further, the front end 15*e* is formed in the lower end of the front side front surface portion 15*d*. Therefore, the front end 15*e* as a stopper regulates movement of the longitudinal surface portion 21 of the holding piece 20 in the direction in which paper is pulled out. Consequently, the tip 43 of the blade 40 does not contact the bottom surface portion 11 and is protected from being damaged.

Further, the back portion 41 of the blade 40 is arranged slightly inclining toward the paper insertion direction to be arranged along the longitudinal surface portion 21 of the holding piece 20. Consequently, paper is inserted easily.

(Operation)

The operation in the above embodiment will be described with reference to FIGS. 6 and 7.

Figure 6:
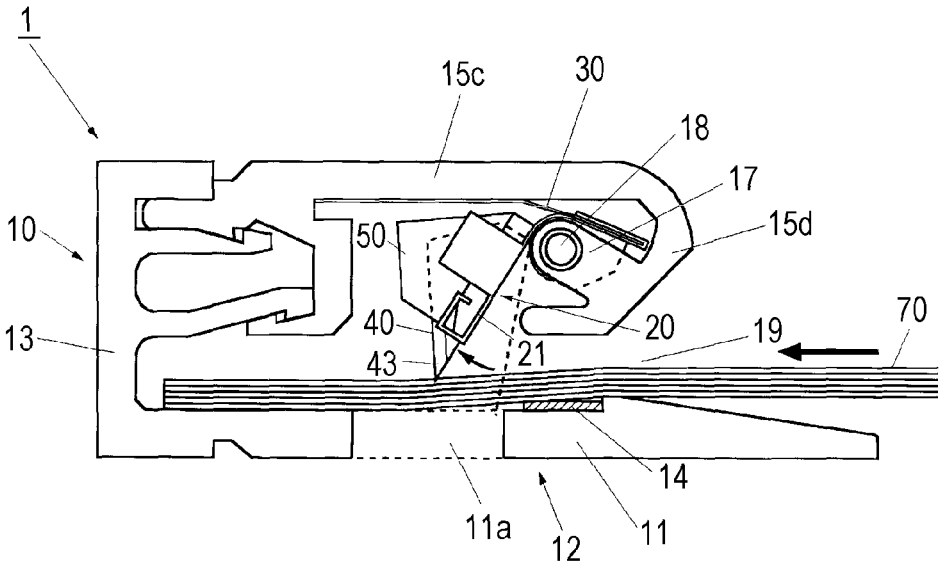
FIG. 6 illustrates a side view illustrating an operation of the paper holder 1.

FIG. 6 illustrates a state where paper 70 is inserted in a direction indicated by an arrow of FIG. 6 from the insertion opening 19. FIG. 7 illustrates a state where the uppermost piece of the inserted paper 70 is being pulled out.

As illustrated in FIG. 6, a plurality of pieces of paper 70 are first inserted adequately inside the case 10 through the insertion opening 19. Then, the front end of the paper 70 lightly abuts on the tip 43 of the blade 40. Further, if insertion of the paper 70 is continued against spring force of the elastic member 30 applied to the holding piece 20 to the insertion opening side, the paper 70 further enters inside. At this time, the longitudinal surface portion 21 of the holding piece 20 rotates in a direction of an arrow in FIG. 6 (toward the insertion direction) from the position indicated by the broken line. The spring force which is applied to the holding piece 20 works such that the paper 70 is pinched between the tip 43 of the blade 40 and the bottom surface portion 11. The tip 43 of the blade 40 abuts on, and cuts in and pierces the uppermost piece of the inserted paper 70. Further, the paper 70 is pinched between the tip 43 of the blade 40 and the bottom surface portion 11 by means of spring force applied to the holding piece 20.

Figure 7:
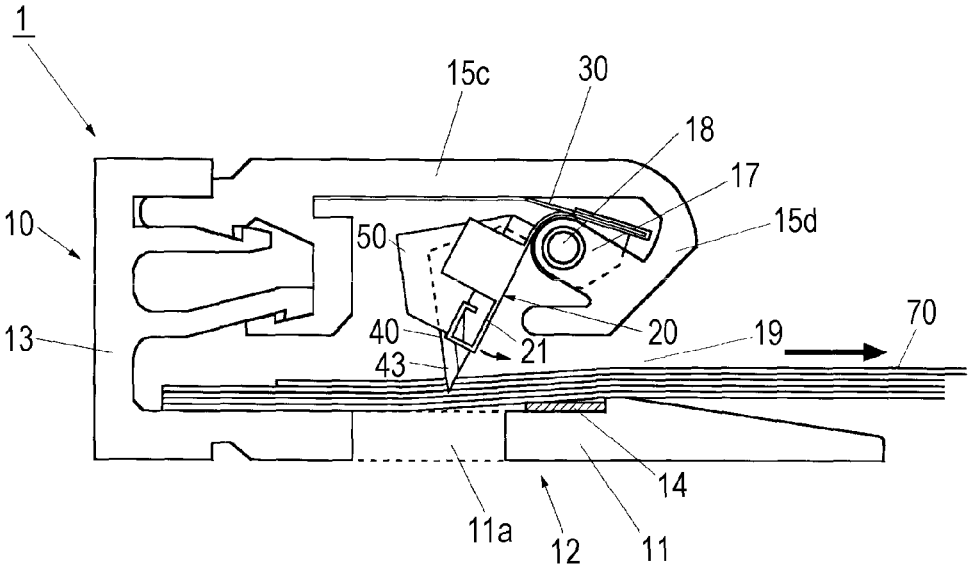
FIG. 7 illustrates a side view illustrating the operation of the paper holder 1.

When the uppermost paper becomes unnecessary, this paper is pulled out in the direction indicated by an arrow from the insertion opening 19 as illustrated in FIG. 7. At this time, by friction force between the tip 43 of the blade 40 and the paper 70 and spring force of the elastic member 30, the holding piece 20 slightly rotates about the axial support portion 17 in the direction of the arrow in FIG. 7 (toward the direction in which paper is pulled out). By this means, the tip 43 of the blade 40 pierces not only the uppermost paper but also the paper below the uppermost paper (generally, a plurality of pieces of paper, for example, two to five pieces of paper). Therefore, the paper 70 except the uppermost paper is held by the tip 43 of the blade 40 and the bottom surface portion 11 does not drop. Consequently, it is possible to reliably pull out only the uppermost paper. At this time, the friction portion 14 effectively functions to prevent the other paper 70 from dropping.

The uppermost paper is pulled out in a state where the tip 43 of the blade 40 is pierced. Therefore, a straight and clear cut line (trace) which goes toward the front end of the paper from the contact point as a start point where the tip 43 of the blade 40 is pierced.

By repeating the above operation, it is possible to easily and reliably pull out paper one by one.

The place to dispose the paper holder 1 and installing means thereof are not limited. The paper holder 1 can be disposed on various wall portions by, for example, an adhesive tape pasted on the back surface of the case 10 (outer surface of the bottom surface portion 11). A plurality of paper holders 1 can be aligned and disposed on a horizontally-long and flat substrate in the lateral direction in accordance with the size of paper to hold.

DESCRIPTION OF REFERENCE SIGNS

1 Paper holder
10 Case
11 Bottom surface portion
12 Mount portion
14 Friction portion
15 Upper covering portion
15*c* Upper surface portion
15*d* Front side front surface portion
17 Axial support portion
19 Paper insertion opening
20 Holding piece
21 Longitudinal surface portion
22 Lateral surface portion
25 Groove portion
26 Bent portion
26*a* Slit
30 Elastic member
40 Blade
41 Back portion
43 Blade tip
44 Blade edge
45 Blade base
46 Inclining side portion of blade
50 Blade fixing member
52 Base portion
53 Standing portion

The invention claimed is:

1. A paper holder comprising:

a case including a mount portion comprising a bottom surface portion, an upper covering portion comprising;

an upper surface portion separated across a space from the bottom surface portion and opposing to the bottom surface portion nearly in parallel, at a front end of the upper surface portion, a front side front surface portion nearly in a U-shape from a side view, and an axial support portion provided inside the front side front surface portion, wherein the mount portion and the upper covering portion being detachably engaged and integrated with each other, and an insertion opening for paper disposed below the front side front surface portion;

a holding piece that is configured to hold inserted paper;

an elastic member configured to bias the holding piece by spring force applied in a direction in which the inserted paper is pulled out;

a blade that is provided to the holding piece, a blade fixing member to which the blade is fixed and configured to hold a perpendicular standing state of the blade with respect to the holding piece; and a friction portion configured to prevent the inserted paper from dropping and provided in an inner surface of the bottom surface portion, wherein the holding piece comprises a plate body having rigidity and is axially supported rotatably by the axial support portion, and the holding piece further includes a longitudinal surface portion that extends from the axial support portion to the bottom surface portion, wherein the blade fixing member is provided in a surface of the longitudinal surface portion on a paper insertion direction side such that a tip of the blade projects from an end of the longitudinal surface portion on a bottom surface portion side, and, wherein the blade fixing member is detachably attached to the holding piece.

2. The paper holder according to claim 1, wherein the holding piece includes a lateral surface portion that is curved in a nearly dogleg shape from a side view and that continues to the longitudinal surface portion, and is further axially supported by the axial support portion in a vicinity of a curved portion where the longitudinal surface portion and the lateral surface portion cross, and the elastic member engages with the lateral surface portion.

3. The paper holder according to claims 1, wherein a bent portion is formed by bending the end of the longitudinal surface portion of the holding piece toward the paper insertion direction side, the blade fixing member is fixed to fit with the bent portion, and a slit through which the blade is inserted is formed in a center portion of the bent portion in a width direction.

4. The paper holder according to claims 1, wherein the blade fixing member includes:

a base portion that is fixable to the longitudinal surface portion; and a standing portion that extrudes perpendicularly away from the base portion and holds a belly portion of the blade from both sides.

5. The paper holder according to claims 1, wherein the blade includes:

a back portion and a blade edge that cross each other to form a sharp tip of the blade; and an inclining side portion that is formed to extend at an angle from a vicinity of a blade base to the back portion.

6. The paper holder according to claim 1, wherein the blade fixing member comprises a recessed groove portion and the holding piece comprises an engagement portion, and wherein the recessed groove portion engages with the engagement portion to detachably attach the blade fixing member to the holding piece.

7. The paper holder according to claim 6, wherein the blade fixing member further comprises projected portions provided on at ends of the blade fixing member in a lateral direction and the holding piece further comprises standing engagement portions provided on at ends of the longitudinal surface portions in the lateral direction, and wherein the projected portions engage with the standing engagement portions to detachably attach the blade fixing member to the holding piece.

8. A paper holder comprising:

a case including:

a mount portion that includes a bottom surface portion, and an upper covering portion having an upper surface portion separated across a space from the bottom surface portion and opposing to the bottom surface portion nearly in parallel, and, at a front end of the upper surface portion, a front side front surface portion nearly in a U-shape from a side view, the mount portion and the upper covering portion being detachably engaged and integrated with each other, an insertion opening for paper being formed below the front side front surface portion;

a holding piece that is provided in the case for holding inserted paper;

an elastic member that biases the holding piece by means of spring force applied in a direction in which the paper is pulled out; and a blade that is provided to the holding piece, wherein the holding piece is formed with a plate body having rigidity and is axially supported rotatably by an axial support portion that is provided inside the front side front surface portion, and the holding piece further includes a longitudinal surface portion that extends from the axial support portion to the bottom surface portion, the blade is fixed to a blade fixing member that holds a perpendicular standing state of the blade with respect to the holding piece, the blade fixing member is provided in a surface of the longitudinal surface portion on a paper insertion direction side such that a tip of the blade projects from an end of the longitudinal surface portion on the bottom surface portion side, a friction portion for preventing the inserted paper from dropping is provided in an inner surface of the bottom surface portion, wherein the holding piece includes a lateral surface portion that is curved in a nearly dogleg shape from a side view and that continues to the longitudinal surface portion, and is further axially supported by the axial support portion in a vicinity of a curved portion where the longitudinal surface portion and the lateral surface portion cross, the elastic member engages with the lateral surface portion, and wherein an end of the lateral surface portion is reversed and folded back to form a groove portion, a plate spring that is the elastic member is arranged virtually along an inner surface of the upper surface portion, and part of the plate spring is inserted in and engaged with the groove portion.

* * * * *